US011141005B2

(12) United States Patent
Steger

(10) Patent No.: US 11,141,005 B2
(45) Date of Patent: Oct. 12, 2021

(54) ADAPTABLE BRACKET ASSEMBLY SYSTEM

(71) Applicant: Kaston Fixtures & Design Group, LLC, Dallas, TX (US)

(72) Inventor: John Steger, Dallas, TX (US)

(73) Assignee: KASTON FIXTURES & DESiGN GROUP, LLC, Dallas, TX (US)

( * ) Notice: Subject to any disclaimer, the term of this patent is extended or adjusted under 35 U.S.C. 154(b) by 6 days.

(21) Appl. No.: 16/509,290

(22) Filed: Jul. 11, 2019

(65) Prior Publication Data

US 2021/0007514 A1 Jan. 14, 2021

(51) Int. Cl.
*A47F 5/10* (2006.01)
*A47F 5/13* (2006.01)

(52) U.S. Cl.
CPC ..... *A47F 5/101* (2013.01); *A47F 5/13* (2013.01)

(58) Field of Classification Search
CPC . A47F 5/101; A47F 5/13; A47F 5/103; A47B 57/404; A47B 57/408; A47B 57/425; A47B 96/07
USPC ..... 248/220.43, 220.31, 221.11, 222.13, 248/222.14, 220.41; 211/57.1, 59.1; D8/354, 363
See application file for complete search history.

(56) References Cited

U.S. PATENT DOCUMENTS 2,060,760 A * 11/1936 Keil ..... A47G 25/06 211/106.01
2,136,109 A * 11/1938 Claudew ..... A47F 5/12 248/221.11
2,312,985 A * 3/1943 Bales ..... A47F 5/0823 248/220.43
2,691,502 A * 10/1954 Jones ..... A47B 96/1416 248/243
3,162,148 A * 12/1964 Ganz ..... A47B 57/045 108/10
3,273,847 A * 9/1966 Berman ..... A47B 57/425 248/243
3,417,872 A * 12/1968 Close ..... A47B 57/045 211/59.1
3,572,626 A * 3/1971 Bertschi ..... A47B 57/045 248/242
3,924,829 A 12/1975 Boundy
4,013,254 A 3/1977 Boundy et al.
4,064,996 A * 12/1977 Shillum ..... A47B 57/402 211/191
4,133,433 A * 1/1979 Wolf ..... A47B 57/40 211/192

(Continued)

*Primary Examiner* — Kimberly T Wood
(74) *Attorney, Agent, or Firm* — Klemchuk LLP

(57) ABSTRACT

Adaptable bracket assemblies may be used with a plurality of different slotted standards. The bracket assembly may include two tabs or teeth, three notches, and a fastening mechanism (such as a tightening screw). The depth and shape of the tabs or teeth may be provided to allow attachment of the bracket assembly to a plurality of different vertical slotted standards. Further, the dimensions of the bracket assembly may allow the bracket assembly to be used adaptably on any of a plurality of different vertical slotted standards (i.e., A line, B, line, C line) that may be installed in a retail environment. Thus, it is not necessary to procure different types of brackets depending on which slotted standard is being used within a retail environment.

8 Claims, 8 Drawing Sheets

(56) References Cited

U.S. PATENT DOCUMENTS 4,198,913 A * 4/1980 Haworth ..... A47B 96/061 108/108
4,219,175 A * 8/1980 Harig ..... A47B 45/00 248/125.3
4,405,110 A * 9/1983 Gibbons ..... A47F 5/0823 248/220.22
4,697,712 A 10/1987 Valiulis
5,022,621 A * 6/1991 Quest ..... A47B 57/408 248/222.13
5,154,388 A 10/1992 Magaro
5,185,971 A * 2/1993 Johnson, Jr. ..... A47B 57/408 211/94.01
5,189,850 A 3/1993 Felton
5,308,031 A 5/1994 Evenson
5,373,793 A 12/1994 Crossman
5,388,796 A 2/1995 Sullivan
5,405,114 A * 4/1995 Dias ..... A47B 96/061 108/108
5,695,078 A 12/1997 Otema
5,785,190 A 7/1998 Otema
6,189,707 B1 2/2001 Meyers et al.
6,364,263 B1 4/2002 Ryan
D547,163 S * 7/2007 Xayoiphonh ..... D8/363
D547,164 S * 7/2007 Xayoiphonh ..... D8/363
7,497,344 B2 * 3/2009 Chen ..... A47B 57/40 108/108
9,044,090 B2 * 6/2015 Drake ..... A47B 57/34
9,591,932 B2 * 3/2017 Lachance ..... A47B 97/001
10,687,617 B2 * 6/2020 Davis ..... A47B 57/425
2002/0109056 A1 8/2002 Weshler et al.
2003/0197102 A1 * 10/2003 Lin ..... A47B 57/42 248/220.43
2007/0042638 A1 * 2/2007 Choi ..... A47B 57/402 439/541.5
2007/0187561 A1 8/2007 Xayoiphonh
2008/0179267 A1 * 7/2008 Johnson ..... A47F 5/083 211/87.01
2016/0007770 A1 * 1/2016 Howard ..... A47F 5/0807 248/220.43
2018/0228303 A1 * 8/2018 Wills ..... A47F 5/0838

* cited by examiner

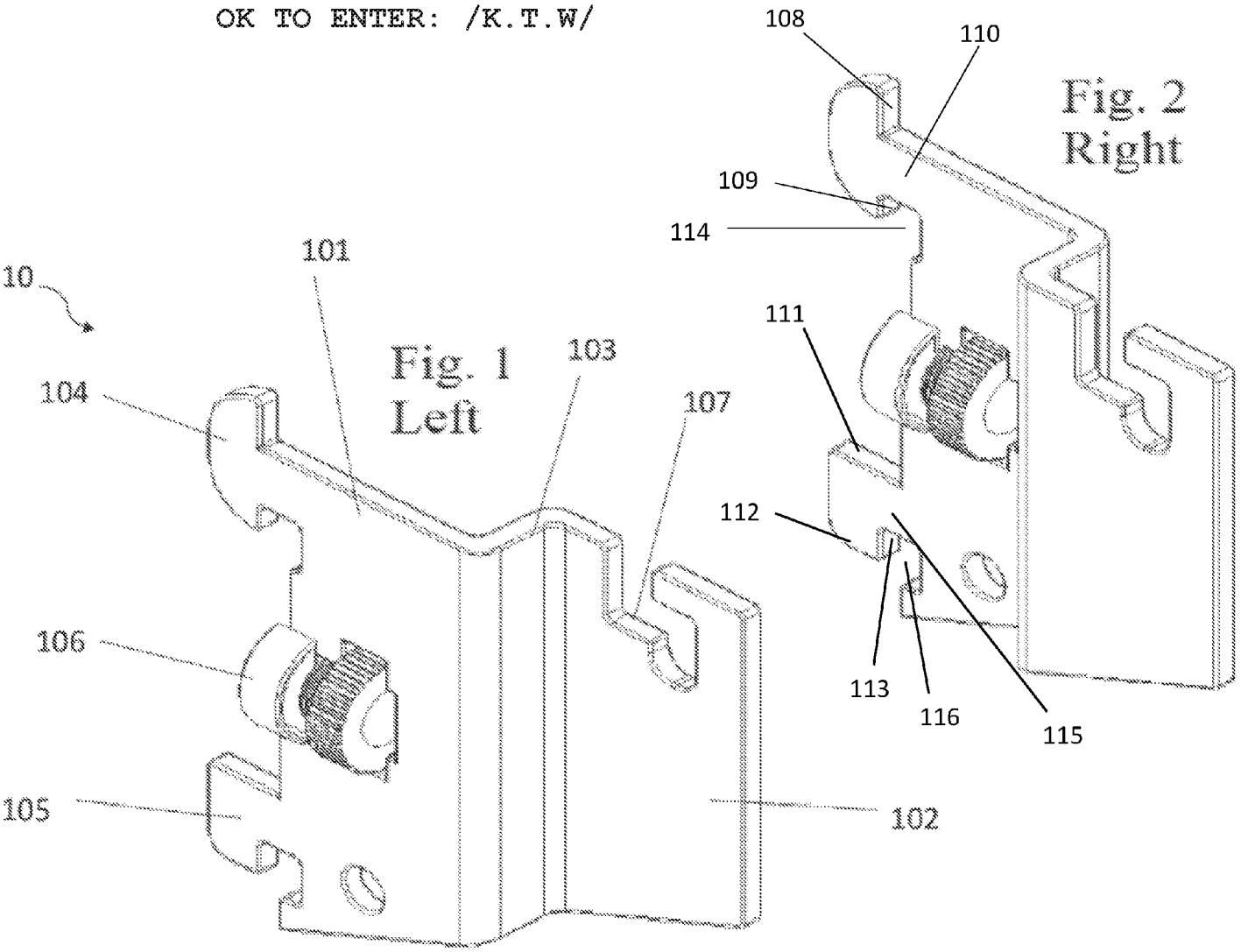
OK TO ENTER: /K.T.W/

Top View
Right

Top View
Left

C-Line
Right

C-Line
Left

B-Line
Right

B-Line
Left

A-Line
Right

A-Line
Left

ADAPTABLE BRACKET ASSEMBLY SYSTEM

FIELD OF THE DISCLOSURE

The present disclosure generally relates to brackets, and more particularly to adaptable bracket assemblies for use with slotted standards for displays.

BACKGROUND

Fixtures and displays are used for visual merchandising in retail environments, specialty stores, and product development. Traditionally, metal strips known as wall standards or slotted standards may be recessed in the wall or surface-mounted to erect displays or retail space on the walls surrounding the store. Different displays or retail spaces may use different slotted standards. There are generally three standard slot sizes. A Line standards have ½" slots that are 1" on center and accept brackets that are 0.625" thick. B Line standards have ½" slots that are 1" on center and accept brackets that are 0.125" thick. C Line standard have 1" slots that are 1" on center and accept brackets that are 0.125" thick. Accordingly, it has been necessary to know what slotted standards are being used in each retail environment so that brackets or other accessories may be matched to the standard(s).

SUMMARY

Embodiments of the present disclosure may provide a bracket assembly that adaptively connects to a plurality of different slotted standards installed vertically in a retail environment, the bracket assembly comprising: a first body portion comprising: an upper tooth with a semicircular shaped head that inserts into a first opening of the plurality of different slotted standards; a lower tooth having a rectangular-shaped head that inserts into a second opening of the plurality of different slotted standards, wherein the upper tooth is parallel to the lower tooth; and a fastener positioned between the upper tooth and the lower tooth to secure the bracket assembly to the plurality of different slotted standards; a second body portion having a notch that receives at least one slat grid panel; and a center body portion that connects the first body portion and the second body portion at right angles relative to the center body portion, wherein the depth and shape of the upper and lower teeth may allow attachment of the bracket assembly to the plurality of different slotted standards. The first body portion and the second body portion may be integrally formed with the center body portion. The upper tooth may include a first flat surface above the semicircular shaped head, a second flat surface below the semicircular shaped head, and a stem portion connected to the semicircular shaped head, the stem portion and the second flat surface forming a notch in the first body portion above the fastener. The lower tooth may include a flat top surface, a curved lower left surface, a flat bottom surface, and a stem portion connected to the rectangular-shaped head, the stem portion and the flat bottom surface forming a notch in the first body portion below the lower tooth. The fastener may be a tightening screw. The notch of the second body portion may be integrally formed with the second body portion from a top surface of the second body portion. The notch of the second body portion may prevent the wire grid panel from popping up out of the notch. The plurality of different slotted standards may include A line standards, B line standards, and C line standards. The plurality of different slotted standards may be recessed or surface-mounted.

Additional embodiments of the present disclosure may provide a bracket assembly that interchangeably connects to a plurality of different vertical slotted standards in a retail environment, the bracket assembly comprising: an upper tooth having a semicircular head that inserts into a first opening of one of the plurality of different vertical slotted standards; a first notch formed below the upper tooth; a lower tooth parallel to the upper tooth, the lower tooth having a rectangular-shaped head that inserts into a second opening of the one of the plurality of different vertical slotted standards; a second notch formed below the lower tooth; and a fastening mechanism positioned between the upper tooth and the lower tooth that secures the bracket assembly to the one of the plurality of different vertical slotted standards. The bracket assembly may further comprise a third notch that receives at least one slat grid panel. The plurality of different vertical slotted standards may include A line standards, B line standards, and C line standards. The bracket assembly may further comprise a first body portion; a second body portion; and a center body portion that connects the first body portion and the second body portion at right angles relative to the center body portion. The upper tooth, the lower tooth, the first notch, the second notch, and the fastening mechanism may be formed in the first body portion. The third notch may be formed in the second body portion. The first body portion and the second body portion may be integrally formed with the center body portion. The upper tooth may include a first flat surface above the semicircular shaped head, a second flat surface below the semicircular shaped head, and a stem portion connected to the semicircular shaped head, the stem portion and the second flat surface forming the first notch in the first body portion above the fastener mechanism. The lower tooth may include a flat top surface, a curved lower left surface, a flat bottom surface, and a stem portion connected to the rectangular-shaped head, the stem portion and the flat bottom surface forming the second notch in the first body portion below the lower tooth. The fastener mechanism may be a tightening screw. The third notch of the second body portion may be integrally formed with the second body portion from a top surface of the second body portion.

BRIEF DESCRIPTION OF THE DRAWINGS

For a more complete understanding of this disclosure, reference is now made to the following description, taken in conjunction with the accompanying drawings, in which:

FIG. 1 depicts a left-side view of an adaptable bracket assembly according to an embodiment of the present disclosure;

FIG. 2 depicts a right-side view of an adaptable bracket assembly according to an embodiment of the present disclosure;

DETAILED DESCRIPTION

Figure 4:
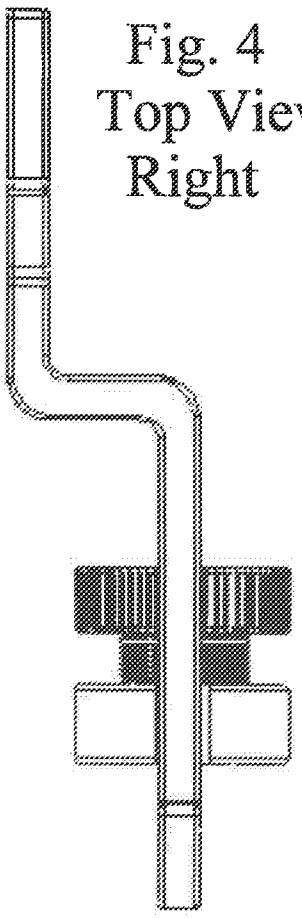
FIG. 4 depicts a top right view of an adaptable bracket assembly according to an embodiment of the present disclosure.

Embodiments of the present disclosure may provide adaptable bracket assemblies that may be used with a plurality of different slotted standards. It should be appreciated that a plurality of different slotted standards may include A line standards, B line standards, and C line standards. While the terms A line standard, B line standard, and C line standard are used herein, it should be appreciated that other terms may be employed to refer to various sizes or qualities (i.e., good, better, best) of slotted standards that may be installed vertically in retail environments in embodiments of the present disclosure. The bracket assembly according to embodiments of the present disclosure may adaptably fit the various slotted standards. Accordingly, a retailer need not procure brackets that are specific to a certain slotted standard. It also should be appreciated that the bracket assembly according to embodiments of the present disclosure may be employed with slotted standards regardless whether they are recessed or surface-mounted.

As will be described in more detail with respect to FIGS. 1-13 below, the bracket assembly according to embodiments of the present disclosure may include two tabs or teeth, three notches, and a fastening mechanism (such as a tightening screw). The depth and shape of the tabs or teeth may be provided to allow attachment of the bracket assembly to a plurality of different vertical slotted standards. Further, the dimensions of the bracket assembly according to embodiments of the present disclosure may allow the bracket assembly to be used adaptably on any of the plurality of different vertical slotted standards (i.e., A line, B, line, C line). Thus, it is not necessary to procure different types of brackets depending on which slotted standard is being used within a retail environment.

FIGS. 1 and 2 depict a left-side view and a right-side view of an adaptable bracket assembly according to an embodiment of the present disclosure. Bracket assembly 10 as depicted in FIGS. 1 and 2 may include first body portion 101 and second body portion 102 integrally formed with center body portion 103 connecting first body portion 101 and second body portion 102 at right angles relative to center body portion 103 in an embodiment of the present disclosure.

First body portion 101 may include upper tooth 104 and lower tooth 105. Upper tooth 104 and lower tooth 105 may integrally be formed with first body portion 101 and extend outward from first body portion 101 with upper tooth 104 positioned parallel to lower tooth 105. Upper tooth 104 may be formed in a semicircular shape that may fit into a first portion of a slotted standard in an embodiment of the present disclosure. The semicircular portion may be inserted into the first portion of a slotted standard, and upper tooth 104 may include flat surfaces on either side of the stem portion of upper tooth 104 that extends from first body portion 104. A notch may be formed below the stem portion of upper tooth 104 as depicted in FIGS. 1-2.

Lower tooth 105 also may include a stem portion that extends from first body portion 104 as described with respect to upper tooth 104. Like upper tooth 104, lower tooth 105 may include a notch that may be formed below the stem portion of lower tooth 105 as depicted in FIGS. 1-2. Lower tooth 105 may assume a rectangular-type shape with a flat top surface and a rounded/curved lower left surface and a flat bottom surface, such as depicted in FIGS. 1-2. The rectangular-type shaped portion of lower tooth 105 may be inserted into a second portion of a slotted standard in an embodiment of the present disclosure.

While upper tooth 104 and lower tooth 105 are referred to herein as teeth, it should be appreciated that there may be embodiments of the present disclosure where upper tooth 104 and lower tooth 105 also may be referred to as tabs. Whether referenced as teeth or tabs, these teeth or tabs are the portions of first body portion 101 that insert into a first and second portion of a slotted standard respectively.

Figure 3:
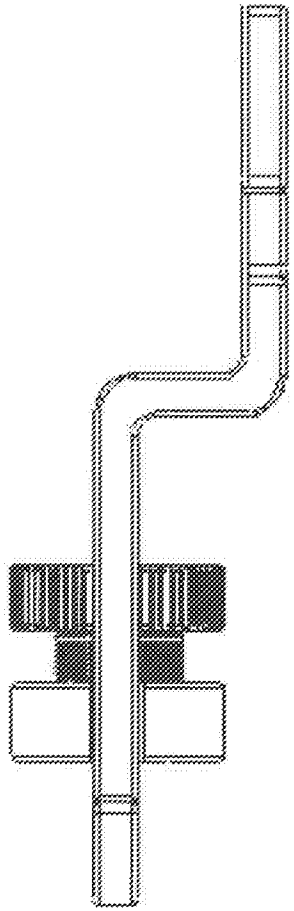
FIG. 3 depicts a top left view of an adaptable bracket assembly according to an embodiment of the present disclosure.

First body portion 101 also may include fastener 106 to fixedly attach bracket assembly 10 to the slotted standard once upper tooth 104 and lower tooth 105 are inserted into the first and second portions of the slotted standard respectively. Fastener 106 may be a bolt or a tightening screw in embodiments of the present disclosure; however, other types of fastening mechanisms may be utilized without departing from the present disclosure. FIGS. 3-4 depict top left and right views of the bracket assembly of FIGS. 1-2 according to an embodiment of the present disclosure. The top left and right views provide a different view of fastener 106.

Second body portion 102 may include notch 107. Notch 107 may be integrally formed with second body portion 102 from the top surface of second body portion 102 as depicted in FIGS. 1-2. Notch 107 may receive a slat grid, which may be a wire grid panel that hangs on bracket assembly 10. The slat grid may be placed within notch 107, and notch 107 may hold the slat grid in place because of its unique shape without the need for additional fastening mechanisms in embodiments of the present disclosure.

In some embodiments of the present disclosure, notch 107 on second body portion 102 may be referred to as a safety notch. When a wire grid panel is hung using bracket assembly 10, notch 107 may help to prevent the wire grid panel from popping up or out of place. Accordingly, notch 107 may be employed as a safety features of bracket assembly 10. Upper tooth 104 may have upper flat surface 108 and lower flat surface 109. Upper tooth 104 may also be connected to first body portion 101 by stem portion 110. Stem portion 110 and lower flat surface 109 may form rectangular first notch 114. Lower tooth 105 may have flat top surface 111, curved lower left surface 112, and flat bottom surface 113. Lower tooth 105 may be connected to first body portion 101 by stem portion 115. Stem portion 115, lower tooth 105, and flat bottom surface 113 may form rectangular second notch 116.

Figure 5:
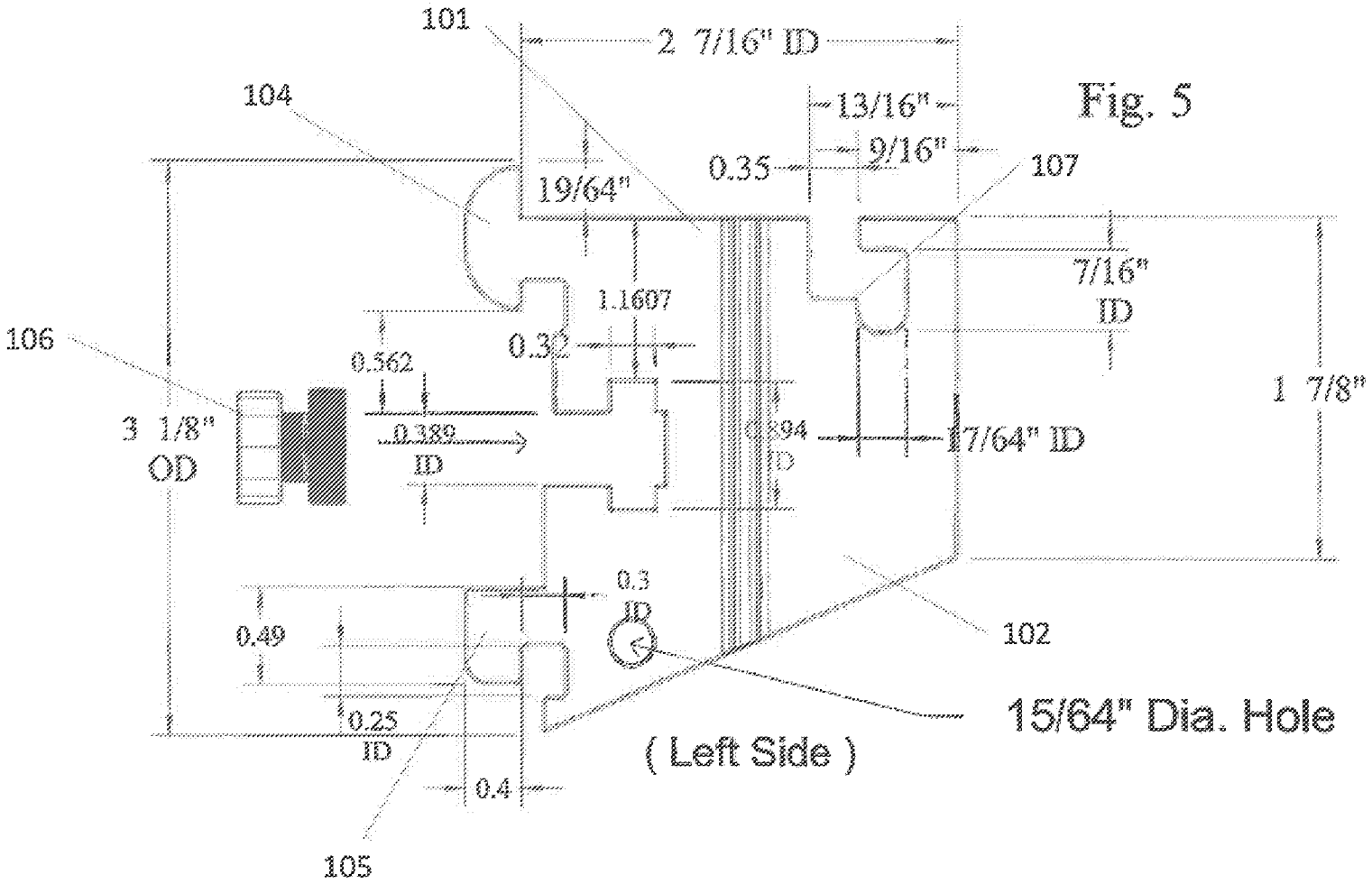
FIG. 5 depicts dimensions of an adaptable bracket assembly according to an embodiment of the present disclosure.

FIG. 5 depict dimensions of a left side view of an adaptable bracket assembly according to an embodiment of the present disclosure. References to OD and ID in FIG. 5 refer to "outer diameter" and "inner diameter" respectively. FIG. 5 includes OD and ID dimensions for the various components described with respect to FIG. 1. These dimensions are representative of this embodiment of the present disclosure, and it should be appreciated that there may be other embodiments where dimensions may be larger or smaller without departing from the present disclosure.

Figure 6:
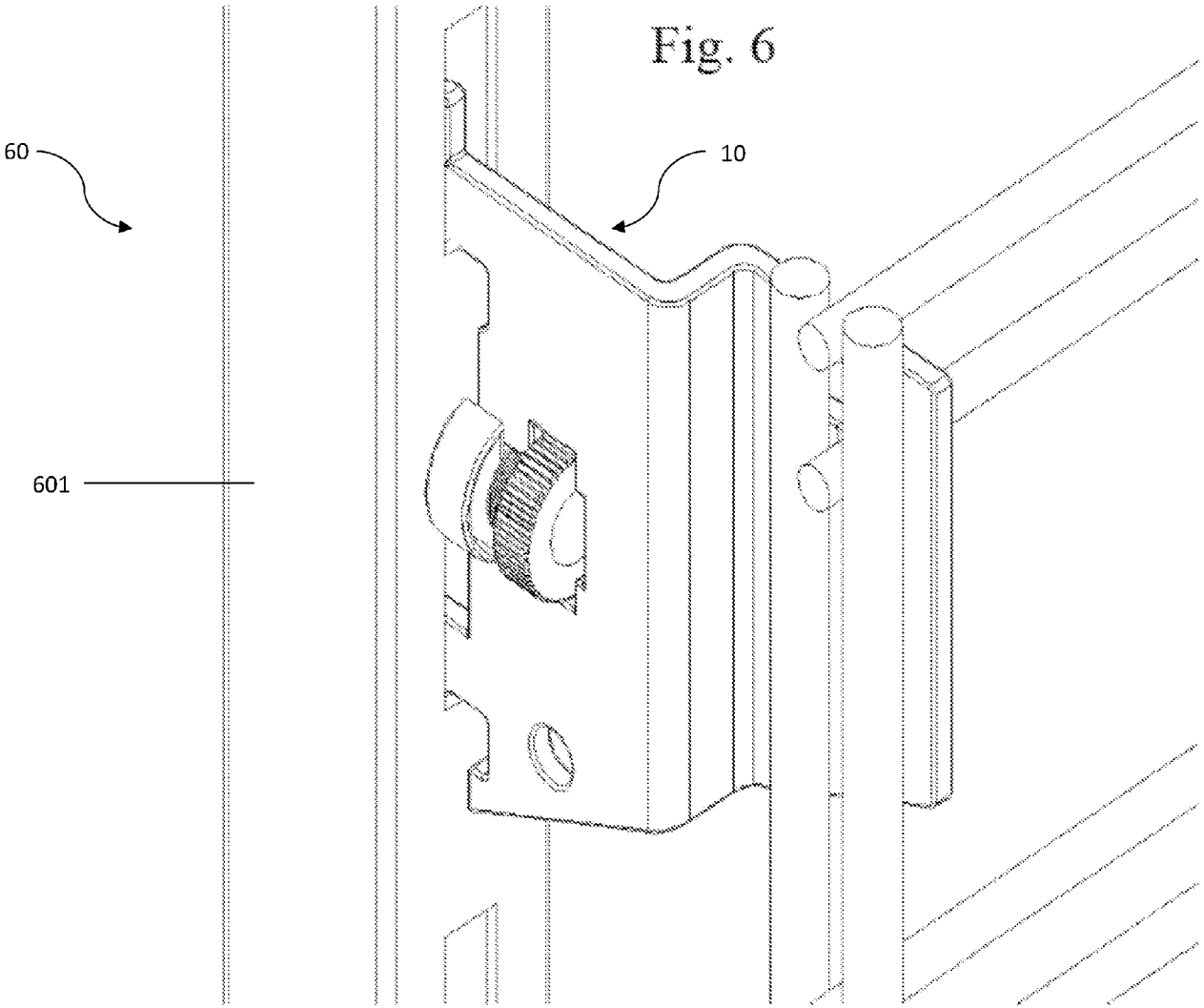
FIG. 6 depicts a view of an installed adaptable bracket assembly according to an embodiment of the present disclosure.
Figure 7:
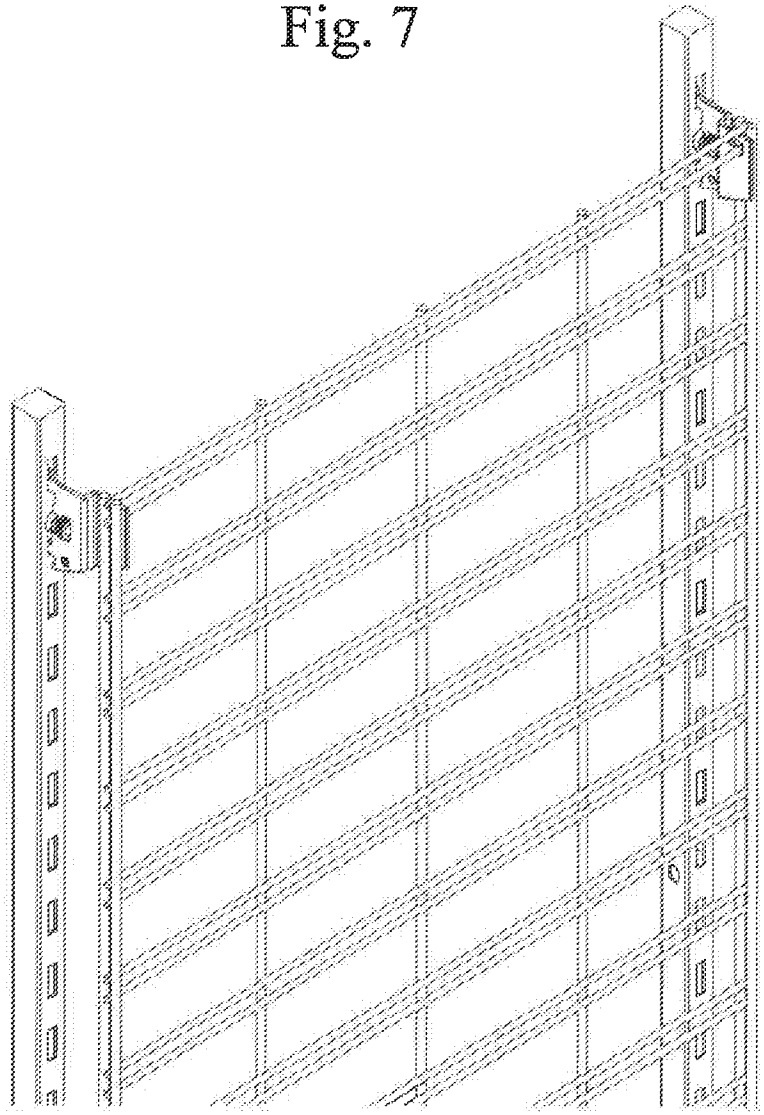
FIG. 7 depicts another view of an installed adaptable bracket assembly according to an embodiment of the present disclosure.

FIG. 6 depicts a view of bracket system 60 according to an embodiment of the present disclosure. In this view, the upper tooth and the lower tooth have been inserted into the opening of slotted standard 601. The fastener has been affixed to slotted standard 601. As bracket assembly 10 has been installed relative to slotted standard(s) 601 and tightened down using the fastener, one or more wire grid panels are depicted as being hung from adaptable bracket assembly 10. FIG. 7 depicts another view of an installed adaptable bracket assembly according to an embodiment of the present disclosure. In this view, two bracket assemblies (left and right) have been installed into an existing vertical slotted standard and tightened down and wire grid panels have been hung from the two bracket assemblies. While only two bracket assemblies are shown installed in FIG. 7, it should be appreciated that additional bracket assemblies may be installed into the vertical slotted standard below or above the depicted bracket assemblies to provide further means to hang wire grid panels (also referred to as slat grids).

Figure 9:
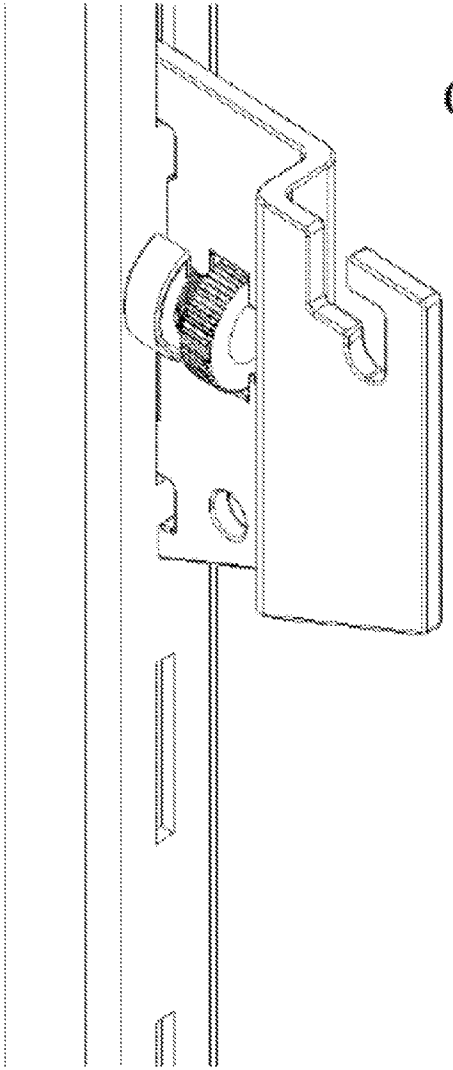
FIG. 9 depicts a right-side view of an adaptable bracket assembly according to an embodiment of the present disclosure attached to a C-line slotted standard.
Figure 8:
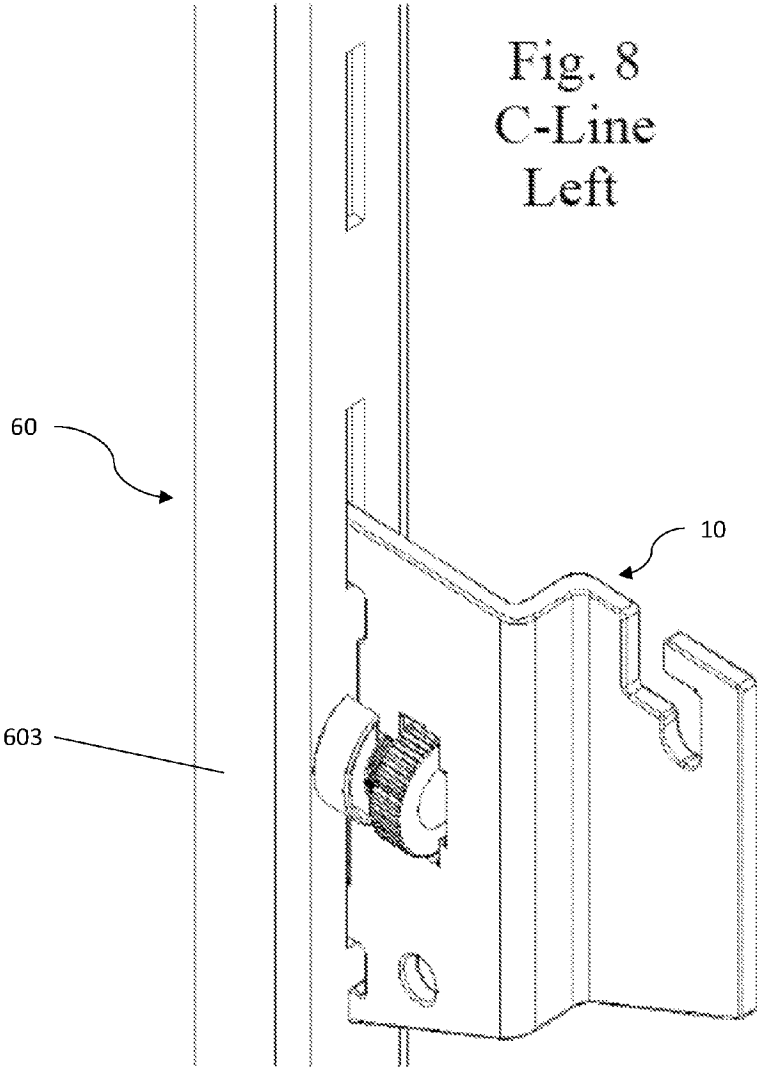
FIG. 8 depicts a left-side view of an adaptable bracket assembly according to an embodiment of the present disclosure attached to a C-line slotted standard.
Figure 11:
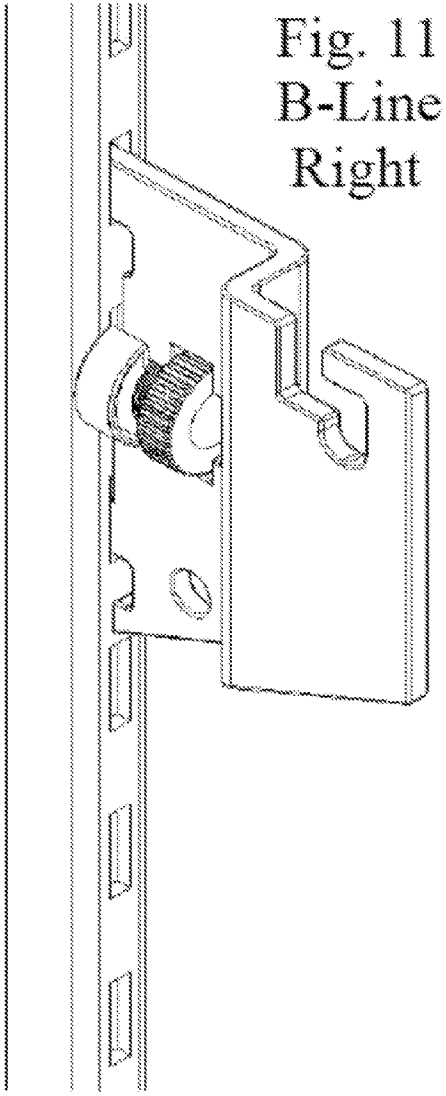
FIG. 11 depicts a right-side view of an adaptable bracket assembly according to an embodiment of the present disclosure attached to a B-line slotted standard.
Figure 10:
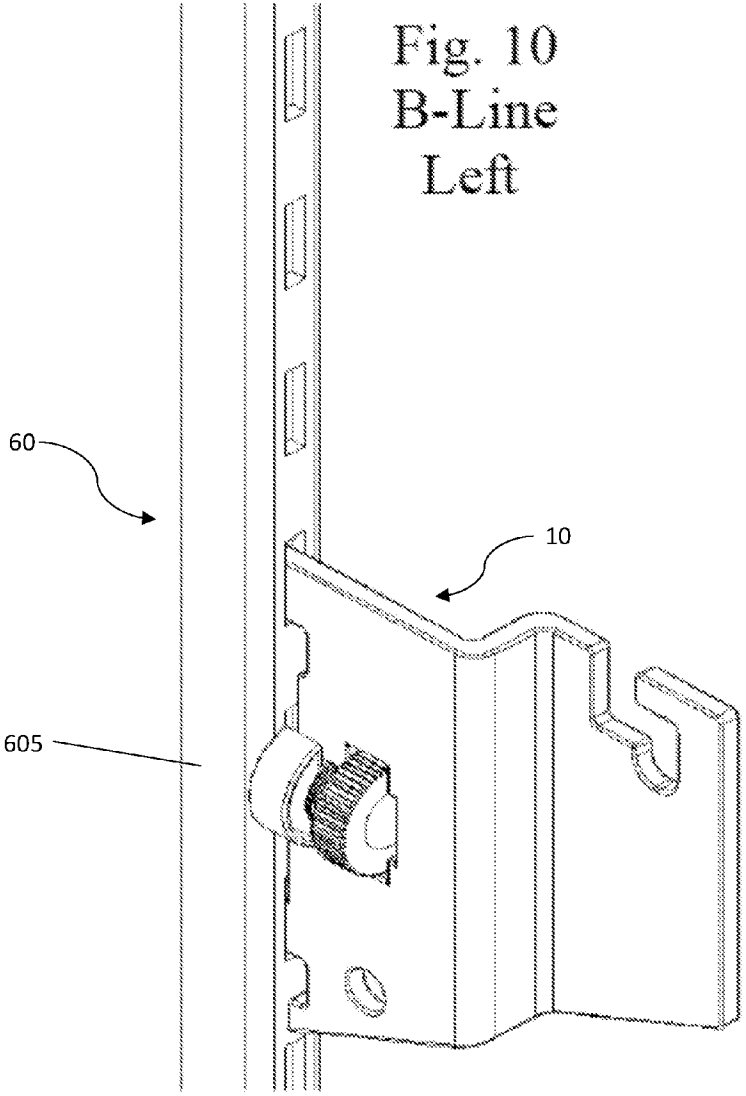
FIG. 10 depicts a left-side view of an adaptable bracket assembly according to an embodiment of the present disclosure attached to a B-line slotted standard.
Figure 13:
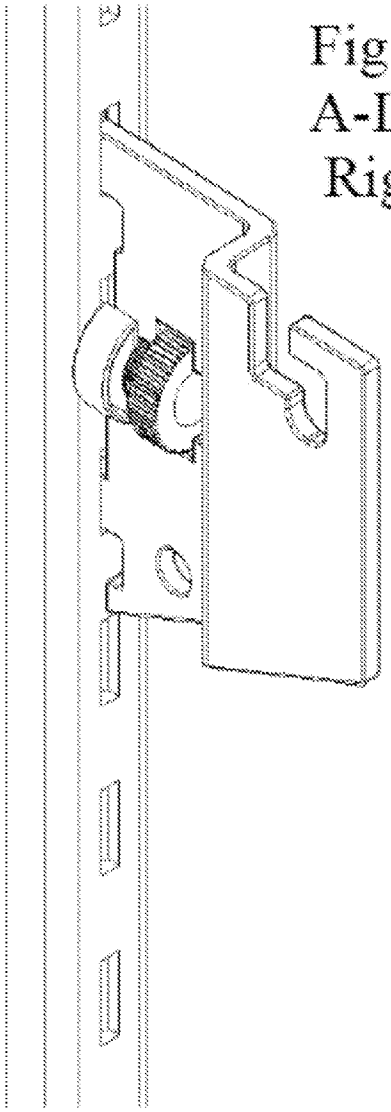
FIG. 13 depicts a right-side view of an adaptable bracket assembly according to an embodiment of the present disclosure attached to an A-line slotted standard.
Figure 12:
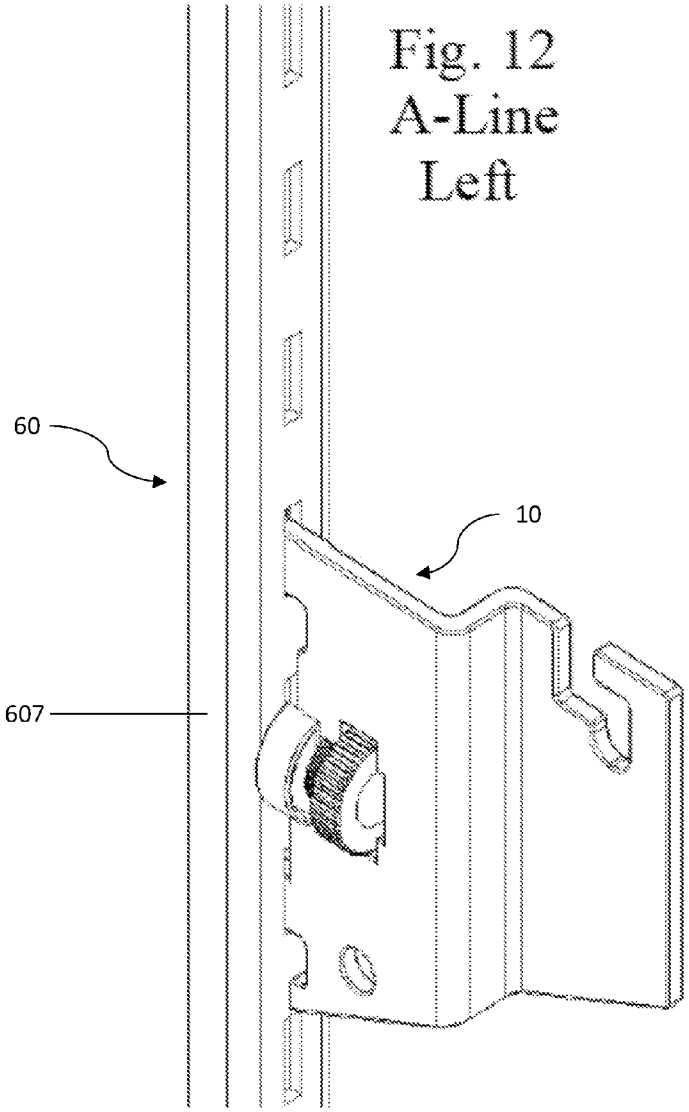
FIG. 12 depicts a left-side view of an adaptable bracket assembly according to an embodiment of the present disclosure attached to an A-line slotted standard.

FIG. 8 depicts a left-side view of bracket system 60 according to an embodiment of the present disclosure which may include bracket assembly 10 attached to C-line slotted standard 603, and FIG. 9 depicts a right-side view of bracket system 60 according to an embodiment of the present disclosure which may include bracket assembly 10 attached to C-line slotted standard 603. FIG. 10 depicts a left-side view of bracket system 60 according to an embodiment of the present disclosure which may include bracket assembly 10 attached to a B-line slotted standard 605, and FIG. 11 depicts a right-side view of bracket system 60 according to an embodiment of the present disclosure which may include bracket assembly 10 attached to a B-line slotted standard 605. FIG. 12 depicts a left side view of bracket system 60 according to an embodiment of the present disclosure which may include bracket assembly 10 attached to A-line slotted standard 607, and FIG. 13 depicts a right-side view of bracket system 60 according to an embodiment of the present disclosure which may include bracket assembly 10 attached to A-line slotted standard 607. As depicted in FIGS. 8-13, the same bracket assembly may be used in an A-line, B-line, and/or C-line vertical slotted standard.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A bracket system installed in a retail environment, the system comprising:

a slotted standard having a first opening and a second opening; and a bracket assembly configured to connect to the slotted standard via the first opening and the second opening, the bracket assembly comprising:

a first body portion comprising:

an upper tooth with a semicircular shaped head that inserts into the first opening of the slotted standard;

a lower tooth having a rectangular-shaped head that inserts into the second opening of the slotted standard, wherein the upper tooth is parallel to the lower tooth; and a support member below the lower tooth and configured to rest against a surface of the slotted standard, wherein the surface is below the second opening, a first rectangular notch formed in the first body between the upper tooth and the lower tooth; a second rectangular notch formed in the first body portion between the lower tooth and the support member;

a fastener positioned between the upper tooth and the lower tooth to secure the bracket assembly to the slotted standard;

a second body portion having a third notch that receives at least one vertical slat grid panel; and a center body portion that connects the first body portion and the second body portion at right angles relative to the center body portion, wherein a depth and shape of the upper tooth and lower tooth and the support member allow selective attachment of the bracket assembly to an A-line said slotted standard, a B-line said slotted standard, or a C-line said slotted standard.

2. The bracket system of claim 1, wherein the first body portion and the second body portion are integrally formed with the center body portion.

3. The bracket system of claim 1, wherein the upper tooth includes a first flat surface on an upper rear portion of the semicircular shaped head, a second flat surface on a lower rear portion of the semicircular shaped head, and a stem portion connected to the semicircular shaped head, the stem portion and the second flat surface forming a notch in the first body portion above the fastener.

4. The bracket system of claim 2, wherein the lower tooth further includes a flat top surface, a curved lower left surface, a flat bottom surface, and a stem portion connected to the rectangular-shaped head, the stem portion and the flat bottom surface forming a notch in the first body portion below the lower tooth.

5. The bracket system of claim 1, wherein the fastener is a tightening screw.

6. The bracket system of claim 1, wherein the third notch of the second body portion is integrally formed with the second body portion from a top surface of the second body portion.

7. The bracket system of claim 1, wherein the third notch of the second body portion prevents the at least one vertical slat grid panel from popping up out of the third notch.

8. The bracket system of claim 2, wherein the slotted standard is recessed or surface-mounted.

* * * * *